US005232041A

United States Patent [19]

Kuhn

[11] Patent Number: 5,232,041

[45] Date of Patent: Aug. 3, 1993

[54] METHOD FOR METALLURGICALLY BONDING CAST-IN-PLACE CYLINDER LINERS TO A CYLINDER BLOCK

[75] Inventor: John W. Kuhn, Bristol, Ind.

[73] Assignee: CMI International, Inc., Southfield, Mich.

[21] Appl. No.: 835,781

[22] Filed: Feb. 14, 1992

[51] Int. Cl.[5] ..... B22D 19/08

[52] U.S. Cl. ..... 164/105; 164/98; 164/100; 164/102; 164/108; 164/493

[58] Field of Search ..... 164/75, 98, 100, 101, 164/102, 103, 104, 105, 493, 513

[56] References Cited

U.S. PATENT DOCUMENTS 1,528,947 3/1925 Preston .
2,455,457 12/1948 Whitfield et al. .
3,069,209 12/1962 Bauer .
3,276,082 10/1966 Thomas .

FOREIGN PATENT DOCUMENTS 0122649 7/1983 Japan ..... 164/103

OTHER PUBLICATIONS

Translation of above reference.

*Primary Examiner*—Samuel M. Heinrich
*Assistant Examiner*—Erik R. Puknys
*Attorney, Agent, or Firm*—Reising, Ethington, Barnard, Perry & Milton

[57] ABSTRACT

A method for metallurgically bonding cast-in-place cylinder liners 12 to a cylinder block 38 includes first coating the outer surface of the liners 12 with a low melting point molten metal material 14 and allowing it to solidify. The coated liners 12 are then positioned within a cylinder block casting mold 22 and molten cylinder block metal introduced into the mold 22. At a time prior to the cylinder block metal contacting and surrounding the coated liners 12, induction heating coils 28 are activated to premelt the coating material 14. The molten cylinder block metal then contacts and mixes with the molten coating metal 14 to form a metallurgical bond between the liners 12 and cylinder block 38 upon solidification.

10 Claims, 1 Drawing Sheet

POWER SOURCE

METHOD FOR METALLURGICALLY BONDING CAST-IN-PLACE CYLINDER LINERS TO A CYLINDER BLOCK

BACKGROUND OF THE INVENTION

1. Field of the Invention

The subject matter of the present invention relates to a method for metallurgically bonding a cast-in-place cylinder liner to a cast cylinder block of an internal combustion engine.

2. Description of the Related Prior Art

It is known to the art to form light weight aluminum cylinder blocks having cast-in-place cylinder liners. These liners are typically made of materials exhibiting wear properties superior to the aluminum cylinder block metal.

One known method for securing the cast-in-place liners within the block is to create a mechanical bond between the liners and block. An example of such a process is disclosed in U.S. Pat. Nos. 1,528,947 to Preston, granted Mar. 10, 1925 and 3,069,209 to Bauer, granted Dec. 18, 1962. Mechanically interlocked cylinder liners, however, tend to loosen over time due to the repeated cycling of temperature experienced during normal operation. Liner retention is, of course, important to the performance of an engine.

One solution to the above problem is to form a metallurgical bond between the cylinder liners and cylinder block. The metallurgical bond unites the liners and the cylinder block with a chemical bond. It is common with this type of process to first coat the outer surface of the cylinder liners with a low melting point metal material, such as zinc. The coated liners are then placed within a cylinder block casting mold after which molten cylinder block metal is cast into the mold and about the coated liners. The heat of the molten metal causes the coating material on the liners to melt in preparation for alloying with the cylinder block metal. Examples of such processes are disclosed in the U.S. Pat. No. 3,276,082 to Thomas, granted Oct. 4, 1966. Although this metallurgical bonding process should, in theory, work, it has been found that an unacceptably limited amount of metallurgical bonding results. It is believed the primary reason for such poor results is attributable to the presence of oxidation on the surface of the coating. The oxidation acts as a barrier to metallurgical bonding by inhibiting the molten cylinder block metal from mixing with the coating material beneath the oxidation.

SUMMARY OF THE INVENTION AND ADVANTAGES

The invention provides a method for metallurgically bonding a cylinder liner to a cylinder block of an internal combustion engine. With this method, the outer surface of the cylinder liner is coated with low melting point molten metal material and allowed to solidify. The coated liner is then disposed within a casting cavity of a cylinder block casting mold after which molten cylinder block metal is introduced into the cavity. The characterizing feature of this method is the step of heating the coated liner to a temperature sufficient to remelt the coating at a time prior to the cylinder block metal contacting the coated liner, wherein the molten cylinder block metal mixes with the coating material and produces a new alloy which metallurgically bonds the liner to the cylinder block upon solidification.

A principle advantage of the subject invention is the formation of a high quality metallurgical bond between the liner and cylinder block. By remelting the coating at a time prior to the molten cylinder block material contacting the coated liner, any oxide present on the outer surface of the coating is easily broken up and penetrated by the molten cylinder block metal. As a result, the cylinder block metal is able to mix and alloy with the underlying coating metal to form the desired metallurgical bond upon solidification.

Another advantage of the present invention is that the coated liners can be prefabricated and stored in an oxidizing environment without having to remove the oxidation prior to use.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figures 1, 2, 3:
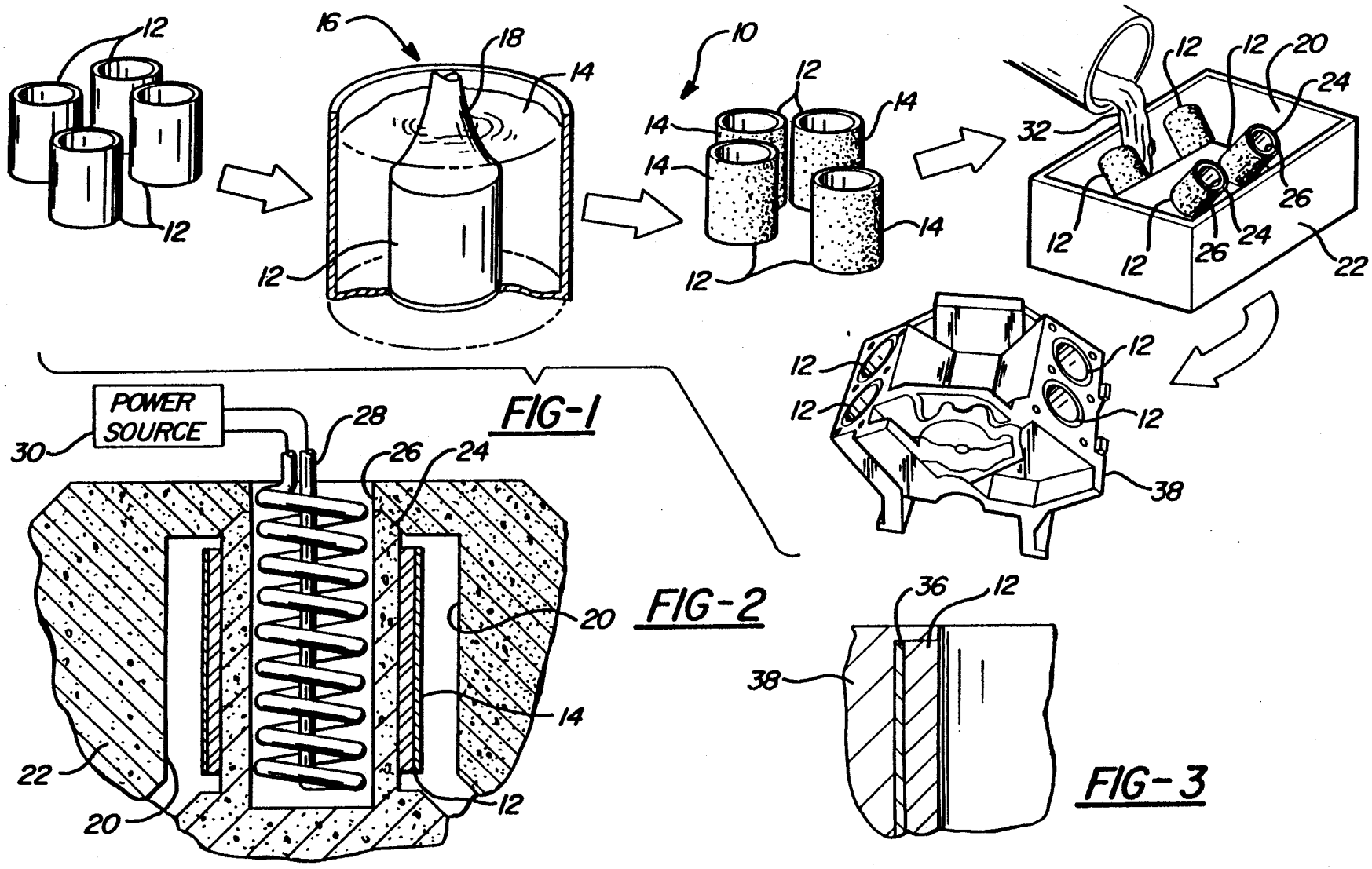
FIG. 1 is a schematic illustration showing the various steps of the subject method.
FIG. 2 is a fragmentary cross-sectional view of the casting mold having a coated liner and an induction heating coil disposed therein.
FIG. 3 is a fragmentary cross-sectional view showing the resultant metallurgical bond formed between the cylinder liner and cylinder block.

The subject invention contemplates a method for metallurgically bonding cylinder liners within a cast cylinder block of an internal combustion engine. The preferred steps for practicing the invention are schematically illustrated at 10 in FIG. 1 and include first forming a selected number of cylinder liners 12. The liners 12 are fabricated of high wear-resistant materials, such as cast iron, steel and high silicon content aluminum alloys, which exhibit good wear properties at high temperatures and are suitable for lining the piston cylinders of an internal combustion engine's cylinder block.

The prefabricated cylinder liners 12 are then coated with a low melting point metal coating material 14, as illustrated at station 16 of FIG. 1. The coating material selected should be one which readily alloys with both the liner material and cylinder block metal. Coating materials such as zinc, tin, cadmium and their alloys are suitable coating materials when the above metals are used as cylinder liner materials and aluminum for the cylinder block metal.

The coating method includes preheating the liners 12, mounting them in a suitable fixture 18 and immersing the liners in a molten bath of the coating material 14. The liners should remain in the molten bath for a time sufficient to enable the coating material to wet the surface of the liners 12 and metallurgically bond therewith. If high silicon content aluminum is used for the cylinder liners 12, then ultrasonic sound waves may be applied to the bath to assist in the coating process.

Once the liners 12 have been coated, they are withdrawn from the bath and allowed to cool. If allowed to cool in an oxidizing atmosphere, the outermost surface of the coating 14 will oxidize. For instance, if zinc is used as the coating material 14, then a thin layer of zinc oxide will form on the outer surface of the coated liner as the coating solidifies.

The coated liners 12 are then positioned within a casting cavity 20 of a cylinder block casting mold 22. Preferably, the coated liners 12 are supported on cylindrical-shaped bonded sand barrel cores 24 extending into the cavity 20 for properly positioning and supporting the liners in-line within the cavity 20 to define the piston cylinders of a cylinder block 38. Each core 24 is formed with a recess 26 extending axially into the core 24 and accessible externally of the casting mold 22. This recess 26 is cylindrical in shape and gives the barrel core 24 a tubular-like appearance.

An induction heating coil 28 is connected to a power supply 30 and inserted into the recess 26 of each core 24 such that the coated liners 12 surround the induction coils 28 and are positioned within the induction heating field produced by the coils 28 when energized.

Once the coated liners 12 are supported on the cores 24 and the induction heating coils 28 positioned within each recess 26, molten cylinder block casting metal 32 is cast into the cavity 20 of the mold 22 as shown at station 34 of FIG. 1. At some point prior to the molten cylinder block metal 32 contacting the coated liners 12, the heating coils 28 are activated and the coating on the liners 12 heated and remelted. With the coating in the molten state, any oxide present on the outer surface of the coated liners 12 is readily broken up and penetrated by the molten cylinder block metal as it rises in the cavity 20 and surrounds the coated liners 12. Due to the compatibility of the coating metal 14 and aluminum cylinder block metal, the two metals locally mix and form a new alloy different in composition from either the cylinder block metal, the coating metal or the cylinder liner metal. Upon solidification, this new alloy forms a metallurgically bonded phase 36 between the resultant cylinder block 38 and each of the liners 12 and metallurgically bonds the liners 12 to the cylinder block 38, as illustrated in FIG. 3. Following casting, the induction heating coils 28 are withdrawn from the recesses 26 and the cylinder block 38 removed from the mold 22.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method of metallurgically bonding a cylinder liner (12) to a cylinder block (38) of an internal combustion engine, said method comprising the steps of:

coating an outer surface of the cylinder liner (12) with a low melting point molten metal coating material (14) and allowing the coating (14) to solidify;

disposing the coated liner (12) within a cavity (20) of a cylinder block casting mold (22) and supporting the liner (12) about a cylinder-shaped barrel core (24) fabricated of a bonded refractory particulate material; disposing an induction heating source (28) within the core (24) and the confines of the liner (12);

casting molten cylinder block metal into the cavity (20) and about the coated liner (17);

and energizing the induction heating source (28) and thereby heating and remelting the coating (14) on the liner (12) before the molten cylinder block metal contacts the coated liner (12), whereby the molten cylinder block metal then combines with the remelted coating material (14) to produce a new alloy which metallurgically bonds the liner (12) to the cylinder block (38) upon solidification.

2. A method as set forth in claim 1 wherein the core (24) has a recess (26) formed therein, further characterized by first forming the core (24) and thereafter inserting the induction heating source (28) within the recess (26) of the prefabricated core (24).

3. A method as set forth in claim 1 further characterized by the coating material comprising zinc-based metal.

4. A method as set forth in claim 1 further characterized by the coating material comprising tin-based metal.

5. A method as set forth in claim 1 further characterized by the cylinder block metal comprising an aluminum-based metal.

6. A method as set forth in claim 1 further characterized by a cylinder liner material comprising cast iron.

7. A method as set forth in claim 1 further characterized by the cylinder liner material comprising steel.

8. A method as set forth in claim 1 further characterized by the cylinder liner material comprising high silicon content aluminum.

9. A method as set forth in claim 1 further characterized by coating and disposing a plurality of the liners (12) in-line within the cavity (20) and metallurgically bonding the same to the cylinder block (38).

10. A method as set forth in claim 2 further characterized by withdrawing the induction heating source (28) from the core (24) following casting.

* * * * *